US008677899B2

(12) United States Patent
DeMoore et al.

(10) Patent No.: US 8,677,899 B2
(45) Date of Patent: Mar. 25, 2014

(54) REVERSIBLE ANTI-MARKING JACKETS AND METHODS OF USING

(75) Inventors: Howard W. DeMoore, Dallas, TX (US); Joey V. Le, Arlington, TX (US)

(73) Assignee: Printing Research, Inc., Dallas, TX (US)

( * ) Notice: Subject to any disclaimer, the term of this patent is extended or adjusted under 35 U.S.C. 154(b) by 434 days.

(21) Appl. No.: 13/018,107

(22) Filed: Jan. 31, 2011

(65) Prior Publication Data

US 2012/0192739 A1 Aug. 2, 2012

(51) Int. Cl.
*B41F 33/00* (2006.01)
*B41F 23/04* (2006.01)

(52) U.S. Cl.
USPC ..... 101/483; 101/416.1; 101/420

(58) Field of Classification Search
USPC ..... 101/483, 416.1, 420, 479, 480
See application file for complete search history.

(56) References Cited

U.S. PATENT DOCUMENTS 3,330,719 A * 7/1967 Hoover ..... 428/138
3,533,355 A 10/1970 Wall
3,791,644 A 2/1974 DeMoore
3,835,778 A 9/1974 Bock
3,960,081 A 6/1976 Gustavs et al.
4,133,264 A 1/1979 Fermi et al.
4,301,878 A 11/1981 Soe
4,402,267 A 9/1983 DeMoore
4,552,631 A 11/1985 Bissot et al.
4,724,762 A 2/1988 Jeschke et al.
4,761,324 A 8/1988 Rautenberg et al.
4,860,650 A 8/1989 Houser
4,894,112 A 1/1990 Lippman
5,046,421 A 9/1991 DeMoore
5,065,122 A 11/1991 Juskey et al.
5,323,702 A 6/1994 Vrotacoe et al.
5,384,019 A 1/1995 Keating et al.
5,396,841 A 3/1995 Güls
5,511,480 A 4/1996 DeMoore et al.
5,549,966 A 8/1996 Sassa
5,603,264 A 2/1997 DeMoore et al.
5,635,124 A 6/1997 Abrams et al.

(Continued)

FOREIGN PATENT DOCUMENTS

EP 1332873 B1 12/2005
EP 2161139 A1 * 3/2010

OTHER PUBLICATIONS

Office Action dated Dec. 14, 2011, U.S. Appl. No. 12/343,481, filed Dec. 24, 2008.

(Continued)

*Primary Examiner* — Ren Yan

(57) ABSTRACT

In a printing press having a transfer cylinder for transferring a freshly printed substrate, an anti-marking device is provided. The anti-marking device comprises a flexible jacket having a first surface and a second surface, each surface having projections projecting from the surface. When the flexible jacket is installed over the transfer cylinder with the second surface positioned facing towards the transfer cylinder the first surface is positioned to engage the freshly printed substrate as it is transferred over the transfer cylinder, and when the flexible jacket is installed over the transfer cylinder with the first surface positioned facing towards the transfer cylinder the second surface is positioned to engage the freshly printed substrate as it is transferred over the transfer cylinder. The anti-marking device is removably attached to the transfer cylinder.

10 Claims, 8 Drawing Sheets

(56) References Cited

U.S. PATENT DOCUMENTS

| | | | | |
|---|---|---|---|---|
| 5,667,611 | A | 9/1997 | Sassa | |
| 5,768,990 | A | 6/1998 | Vrotacoe et al. | |
| 5,785,105 | A | 7/1998 | Crider et al. | |
| 5,842,412 | A | 12/1998 | Greenway et al. | |
| 5,842,419 | A | 12/1998 | Puschnerat | |
| 5,907,998 | A | 6/1999 | DeMoore et al. | |
| 5,918,317 | A | 7/1999 | Bernhardt | |
| 5,957,421 | A | 9/1999 | Barbour | |
| 5,979,322 | A | 11/1999 | DeMoore et al. | |
| 6,073,556 | A | 6/2000 | DeMoore et al. | |
| 6,119,597 | A | 9/2000 | DeMoore et al. | |
| 6,192,800 | B1 | 2/2001 | DeMoore et al. | |
| 6,205,922 | B1 * | 3/2001 | Henry et al. | 101/376 |
| 6,244,178 | B1 | 6/2001 | DeMoore et al. | |
| 6,393,249 | B1 | 5/2002 | Aslam et al. | |
| D463,134 | S | 9/2002 | Vosbikian | |
| 6,647,237 | B2 | 11/2003 | Schlueter, Jr. et al. | |
| 6,901,859 | B2 | 6/2005 | Yokoyama | |
| 6,984,830 | B2 | 1/2006 | Burgio | |
| 7,021,210 | B2 | 4/2006 | Elliott et al. | |
| RE39,305 | E | 9/2006 | DeMoore et al. | |
| 7,270,873 | B2 | 9/2007 | Rizika et al. | |
| 7,403,594 | B2 | 7/2008 | Endo et al. | |
| 7,438,115 | B2 | 10/2008 | Bohlen | |
| 7,478,592 | B2 | 1/2009 | Zahnd et al. | |
| 7,593,234 | B2 | 9/2009 | Okuda | |
| 8,146,497 | B2 | 4/2012 | Caliari | |
| 8,166,878 | B2 | 5/2012 | Saito | |
| 8,220,338 | B2 | 7/2012 | Tojo | |
| 8,220,388 | B2 | 7/2012 | DeMoore et al. | |
| 8,281,716 | B2 | 10/2012 | DeMoore et al. | |
| 8,397,634 | B2 | 3/2013 | DeMoore et al. | |
| 8,424,453 | B2 | 4/2013 | DeMoore | |
| 2001/0042469 | A1 | 11/2001 | Vosseler | |
| 2002/0155289 | A1 | 10/2002 | Cistone et al. | |
| 2003/0113466 | A1 | 6/2003 | Frazzitta et al. | |
| 2003/0226461 | A1 | 12/2003 | Miller | |
| 2004/0219358 | A1 | 11/2004 | Tokarsky et al. | |
| 2004/0259033 | A1 | 12/2004 | Kunita | |
| 2005/0212878 | A1 | 9/2005 | Studer et al. | |
| 2006/0249041 | A1 | 11/2006 | DeMoore et al. | |
| 2007/0202442 | A1 | 8/2007 | Zwadlo | |
| 2007/0207186 | A1 | 9/2007 | Scanlon et al. | |
| 2007/0227379 | A1 | 10/2007 | Sato et al. | |
| 2007/0261579 | A1 | 11/2007 | Rizika | |
| 2008/0026201 | A1 | 1/2008 | Rizika et al. | |
| 2008/0106001 | A1 | 5/2008 | Slafer | |
| 2010/0101441 | A1 | 4/2010 | DeMoore et al. | |
| 2010/0154665 | A1 | 6/2010 | DeMoore et al. | |
| 2010/0154667 | A1 | 6/2010 | DeMoore et al. | |
| 2010/0307357 | A1 | 12/2010 | DeMoore | |
| 2012/0048134 | A1 | 3/2012 | DeMoore | |
| 2012/0073463 | A1 | 3/2012 | DeMoore | |
| 2012/0152138 | A1 | 6/2012 | DeMoore et al. | |
| 2012/0192743 | A1 | 8/2012 | DeMoore et al. | |
| 2012/0325100 | A1 | 12/2012 | DeMoore et al. | |
| 2013/0152810 | A1 | 6/2013 | DeMoore et al. | |

OTHER PUBLICATIONS

Office Action dated Dec. 13, 2011, U.S. Appl. No. 12/343,484, filed Dec. 24, 2008.

Office Action dated Dec. 27, 2011, U.S. Appl. No. 12/258,225, filed Oct. 24, 2008.

Notice of Allowance dated Mar. 23, 2012, U.S. Appl. No. 12/343,484, filed Dec. 24, 2008.

Demoore, Howard, et al., Patent Application entitled "Hook to Fabric Fastener Closure Tool," filed Feb. 29, 2012, U.S. Appl. No. 13/408,887.

Office Action Restriction dated Aug. 21, 2012, U.S. Appl. No. 12/832,803, filed Jul. 8, 2010.

Office Action dated Aug. 22, 2012, U.S. Appl. No. 12/874,154, filed Sep. 1, 2010.

DeMoore, Howard W., et al., Patent Application entitled, "Anti-marking Jackets Comprised of Fluoropolymer and Methods of Using in Offset Printing," filed Sep. 4, 2012, U.S. Appl. No. 13/603,413.

DeMoore, Howard, et al., Patent Application entitled "Anti-marking jackets Comprised of Fluoropolymer and Methods of Using in Offset Printing," filed Oct. 5, 2012, U.S. Appl. No. 13.646,657.

Foreign Communication From a Related Counterpart Application—International Search Report and Written Opinion, PCT/US2009/068311, Mar. 11, 2010.

Foreign Communication From a Related Counterpart Application—International Preliminary Report on Patentability, PCT/US2009/068311, Jul. 7, 2011.

Foreign Communication From a Related Counterpart Application—International Search Report and Written Opinion, PCT/US2009/061527, Dec. 22, 2009.

Foreign Communication From a Related Counterpart Application—International Preliminary Report on Patentability, PCT/US2009/061527, May 5, 2011.

Office Action Restriction dated Oct. 18, 2011, U.S. Appl. No. 12/343,481, filed Dec. 24, 2008.

Office Action Restriction dated Nov. 4, 2011, U.S. Appl. No. 12/343,484, filed Dec. 24, 2008.

Office Action Restriction dated Sep. 14, 2011, U.S. Appl. No. 12/258,225, filed Oct. 24, 2008.

DeMoore, Howard, et al., Patent Application entitled "Reversible Anti-marking Jackets and Methods of Using," filed Sep. 2, 2011, U.S. Appl. No. 13/224,394.

DeMoore, Howard, Patent Application entitled "Apparatus and Method for Adjusting Anti-marking Jackets," filed Sep. 1, 2010, U.S. Appl. No. 12/874,154.

DeMoore, Howard, Patent Application entitled "Hook to Fabric Fastener Closure Tool," filed Sep. 24, 2010, U.S. Appl. No. 12/890,393.

Notice of Allowance dated Jul. 18, 2012, U.S. Appl. No. 12/343,481, filed Dec. 24, 2008.

Final Office Action dated Apr. 11, 2013, U.S. Appl. No. 12/832,803, filed Jul. 8, 2010.

First Action Interview Pre-Interview Communication dated Apr. 19, 2013, U.S. Appl. No. 13/769,543, filed Feb. 18, 2013.

Office Action—Restriction Requirement dated Apr. 17, 2013, U.S. Appl. No. 12/890,393, filed Sep. 24, 2010.

DeMoore, Howard W., et al., Patent Application entitled, "Anti-marking Jackets Comprised of Fluoropolymer and Methods of Using in Offset Printing," filed Feb. 18, 2013, U.S. Appl. No. 13/769,543.

DeMoore, Howard, et al., Patent Application entitled "Beaded Partially Coated Ant-Marking Jackets," filed May 2, 2012, U.S. Appl. No. 13/462,431.

DeMoore, Howard, et al., Patent Application entitled "Anti-marking jackets Comprised of Fluoropolymer and Methods of Using in Offset Printing," filed Feb. 20, 2013, U.S. Appl. No. 13/771,554.

Notice of Allowance dated Jul. 8, 2013, U.S. Appl. No. 12/832,803, filed Jul. 8, 2010.

Second First Action Interview Pre-Interview Communication dated Jul. 15, 2013, U.S. Appl. No. 13/769,543, filed Feb. 18, 2013.

Office Action dated Jul. 10, 2013, U.S. Appl. No. 12/890,393, filed Sep. 24, 2010.

Office Action dated Nov. 8, 2012, U.S. Appl. No. 12/832,803, filed Jul. 8, 2010.

Notice of Allowance dated Nov. 2, 2012, U.S. Appl. No. 13/603,413, filed Sep. 4, 2012.

Notice of Allowance dated Dec. 6, 2012, U.S. Appl. No. 12/874,154, filed Sep. 1, 2010.

Final Office Action dated May 16, 2012, U.S. Appl. No. 12/343,481, filed Dec. 24, 2008.

Supplemental Notice of Allowance dated Apr. 11, 2012, U.S. Appl. No. 12/343,484, filed Dec. 24, 2008.

Foreign Communication From a Related Counterpart Application—International Search Report and Written Opinion, PCT/US2012/023204, May 10, 2012.

* cited by examiner

REVERSIBLE ANTI-MARKING JACKETS AND METHODS OF USING

CROSS-REFERENCE TO RELATED APPLICATIONS

None.

STATEMENT REGARDING FEDERALLY SPONSORED RESEARCH OR DEVELOPMENT

Not applicable.

REFERENCE TO A MICROFICHE APPENDIX

Not applicable.

BACKGROUND

In the operation of a rotary offset printing press, freshly printed substrates, such as sheets or web material, are guided by transfer cylinders or the like from one printing unit to another, and then they are delivered to a sheet stacker or to a sheet folder/cutter unit, respectively. As used herein, the term "transfer cylinder" includes delivery cylinders, transfer rollers, support rollers, support cylinders, delivery wheels, skeleton wheels, segmented wheels, transfer drums, support drums, spider wheels, support wheels, guide wheels, guide rollers, and the like.

The ink marking problems inherent in transferring freshly printed substrates have been longstanding. In order to minimize the contact area between the transfer means and the freshly printed substrate, conventional support wheels have been modified in the form of relatively thin disks having a toothed or serrated circumference, referred to as skeleton wheels. However, those thin disc transfer means have not overcome the problems of smearing and marking the freshly printed substrate due to moving contact between the freshly printed substrate and the projections or serrations. Moreover, the attempts to cover the transfer cylinder with a cover material and/or minimize the surface support area in contact with the freshly printed substrate material often resulted in further problems.

Various efforts have been made to overcome the limitations of thin disk skeleton wheels. One of the most important improvements has been completely contrary to the concept of minimizing the surface area of contact. That improvement is disclosed and claimed in U.S. Pat. No. 3,791,644 to Howard W. DeMoore, incorporated by reference herein in its entirety, wherein the support surface of a transfer cylinder in the form of a wide wheel or cylinder is coated with an improved ink repellent surface formed by a layer of polytetrafluoroethylene (PTFE).

During the use of the PTFE coated transfer cylinders in high-speed commercial printing presses, the surface of the coated cylinders must be washed frequently with a solvent to remove any ink accumulation. Moreover, it has also been determined that the PTFE coated cylinders do not provide a cushioning effect and relative movement, which are beneficial.

The limitations on the use of the PTFE coated transfer cylinders have been overcome with an improved transfer cylinder having an ink repellent, cushioning, and supportive fabric covering or the like for transferring the freshly printed sheet. It is now well recognized and accepted in the printing industry world-wide that marking and smearing of freshly printed sheets caused by engagement of the wet printed surface with the supporting surface of a conventional press transfer cylinder is substantially reduced by using the anti-marking fabric covering system as disclosed and claimed in my U.S. Pat. No. 4,402,267 entitled "Method and Apparatus for Handling Printed Sheet Material," the disclosure of which is incorporated herein by reference.

That system, which is marketed under license by Printing Research, Inc. of Dallas, Tex., U.S.A. under the registered trademark SUPER BLUE® includes the use of a low friction coating or coated material on the supporting surface of the transfer cylinder, and over which is loosely attached a movable fabric covering. The fabric covering provided a yieldable, cushioning support for the freshly printed side of the substrate such that relative movement between the freshly printed substrate and the transfer cylinder surface would take place between the fabric covering and the support surface of the transfer cylinder so that marking and smearing of the freshly printed surface was substantially reduced. Various improvements have been made to the SUPER BLUE® system, which are described in more detail in U.S. Pat. Nos. 5,907,998 and 6,244,178 each entitled "Anti-Static, Anti-Smearing Pre-Stretched and Pressed Flat, Precision-Cut Striped Flexible Coverings for Transfer Cylinders"; U.S. Pat. Nos. 5,511,480, 5,603,264, 6,073,556, 6,119,597, and 6,192,800 each entitled "Method and Apparatus for Handling Printed Sheet Material"; U.S. Pat. No. 5,979,322 entitled "Environmentally Safe, Ink Repellent, Anti-Marking Flexible Jacket Covering Having Alignment Stripes, Centering Marks and Pre-Fabricated Reinforcement Strips for Attachment onto Transfer Cylinders in a Printing Press"; and U.S. Pat. No. RE39,305 entitled "Anti-static, Anti-smearing Pre-stretched and Pressed Flat, Precision-cut Striped Flexible Coverings for Transfer Cylinders," each of which is hereby incorporated by reference herein in its entirety. The above cited patents are all owned by Printing Research, Inc. of Dallas, Tex., U.S.A.

SUMMARY

In an embodiment, in a printing press having a transfer cylinder for transferring a freshly printed substrate, an anti-marking device is provided. The anti-marking device comprises a flexible jacket having a first surface and a second surface, each surface having projections projecting from the surface. When the flexible jacket is installed over the transfer cylinder with the second surface positioned facing towards the transfer cylinder the first surface is positioned to engage the freshly printed substrate as it is transferred over the transfer cylinder, and when the flexible jacket is installed over the transfer cylinder with the first surface positioned facing towards the transfer cylinder the second surface is positioned to engage the freshly printed substrate as it is transferred over the transfer cylinder. The anti-marking device is removably attached to the transfer cylinder.

In an embodiment, a method of operating a printing press is disclosed. The method comprises installing a flexible jacket having a first surface and a second surface over a cylinder of the printing press with the second surface facing the cylinder, wherein each of the first surface and the second surface have projections projecting from the surface, and after installing the flexible jacket with the second surface facing the cylinder, printing a first plurality of substrates using the printing press. The method further comprises, after printing the first plurality of substrates, removing the flexible jacket from the cylinder, after removing the flexible jacket from the cylinder, installing the flexible jacket over the cylinder with the first surface facing the cylinder, and, after installing the flexible jacket with the first surface facing the cylinder, printing a second plurality of substrates using the printing press.

In an embodiment, a kit is disclosed. The kid comprises a shipping carton and a plurality of flexible jackets. Each flexible jacket has a first anti-marking surface and a different second anti-marking surface, wherein when the flexible jacket is installed over a cylinder of a printing press with the second anti-marking surface positioned facing towards the cylinder the first anti-marking surface is positioned to engage a freshly printed substrate as it is transferred over the cylinder, wherein when the flexible jacket is installed over the cylinder with the first anti-marking surface positioned facing towards the cylinder the second anti-marking surface is positioned to engage the freshly printed substrate as it is transferred over the cylinder.

These and other features will be more clearly understood from the following detailed description taken in conjunction with the accompanying drawings and claims.

BRIEF DESCRIPTION OF THE DRAWINGS

For a more complete understanding of the present disclosure, reference is now made to the following brief description, taken in connection with the accompanying drawings and detailed description, wherein like reference numerals represent like parts.

DETAILED DESCRIPTION

Figure 1A:
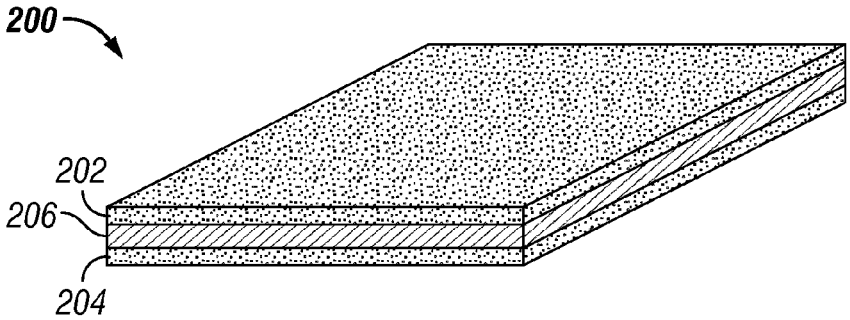
FIG. 1A is a view of a flexible jacket according to an embodiment of the disclosure.

It should be understood at the outset that although illustrative implementations of one or more embodiments are illustrated below, the disclosed systems and methods may be implemented using any number of techniques, whether currently known or in existence. The disclosure should in no way be limited to the illustrative implementations, drawings, and techniques illustrated below, but may be modified within the scope of the appended claims along with their full scope of equivalents.

In an embodiment, a transfer cylinder or other cylinder of a printing press may be at least partially enclosed by a flexible jacket that is installed over the cylinder, the flexible jacket comprising two anti-marking surfaces, each anti-marking surface having a plurality of projections, for example, a plurality of small beads, small bodies, or other small particles having any of a variety of geometries coupled to the anti-marking surfaces. In some contexts the flexible jacket may be referred to as an anti-marking jacket and may be said to have two anti-marking surfaces. In some embodiments, a cylinder base cover, hereinafter referred to as a base cover, may be installed over the cylinder, for example a low friction base cover, and the flexible jacket may be installed on the cylinder over the base cover. In other embodiments, however, a base cover may be omitted and the flexible jacket may be installed over the cylinder with no intervening base cover. As substrates are printed and moved through the printing press they are supported, at least in part, by the flexible jacket and more particularly by the plurality of projections from the surface of one of the anti-marking surfaces of the flexible jacket.

The projections project above the anti-marking surface of the flexible jacket and touch the printed substrates in a reduced number of points thereby reducing marking of the substrates through smearing the wet ink. The projections may comprise any of a variety of small bodies or particles of a variety of geometries that are coupled to the anti-marking surface. For example, the small bodies may comprise spherical beads, egg-shaped beads, oblong beads, hemispherical beads, toroidal shaped beads, rounded pyramid shaped beads, polygonal shaped beads, and other shaped beads or particles. In an embodiment, the projections are comprised at least in part of plastic material, glass material, silicon material, and/or ceramic material. Alternatively, the projections may be formed by a process that does not entail coupling beads, bodies, or particles to the anti-marking surface. For example, the projections may be formed by removing material from the anti-marking surface to leave projections separated by gouged out or cut out areas such as holes and/or grooves. Alternatively, the projections may be formed by stippling the anti-marking surface.

Without wishing to be bound by theory, it is thought that the projections may present reduced friction relative to other alternative materials and that this reduced friction may itself contribute to a reduction of marking. In some cases the flexible jacket may be installed tautly over the cylinder, while in other cases the flexible jacket may be installed loosely over the cylinder. While in the following the discussion typically refers to installing the flexible jacket over a transfer cylinder, it is understood that the present disclosure teaches using the flexible jacket installed over other cylinders in a printing press, for example installed over perfection cylinders, over delivery cylinders, and over other cylinders.

As the flexible jacket undergoes a number of printing cycles the surface of the flexible jacket engaging the printed substrates, the outward facing anti-marking surface, and the projections in this anti-marking surface, may wear to a point that the subject flexible jacket may no longer function effectively to reduce marking of substrates. Alternatively or in addition, the flexible jacket may accumulate an undesirable build-up of ink, solvent, or other material such that the subject flexible jacket is no longer functioning suitably. Alternatively, repeated washings may remove enough beads or particles or smooth down projections to render the flexible jacket no longer functional. According to the teaching of the present disclosure, the flexible jacket having two anti-marking surfaces with projections may be removed from the transfer cylinder, reversed, and reattached to the transfer cylinder with the worn anti-marking surface and projections facing the transfer cylinder and with the other anti-marking surface with projections facing outwards to engage the printed substrates. The alternate anti-marking surface with projections, not having been used previously for engaging printed substrates, would be expected to be in substantially new condition and hence to provide a substantially full service life.

The flexible jacket taught herein may extend the service life of the flexible jacket to twice the normal service life of known flexible jackets having only a single side having projections. Because manufacturing efficiencies may be realized in manufacturing the flexible jacket with two surfaces having projections, as described in more detail below, the two sided flexible jackets may be priced to sell for less than two single sided flexible jackets. Additionally, labor efficiencies may be realized because the press operator need not walk away from the press to retrieve a replacement jacket but instead has, effectively, the replacement already in his or her hands when the worn jacket has been taken off the transfer cylinder. Effectively, the frequency that a replacement flexible jacket would need to be retrieved from stock would be substantially halved. In some circumstances, the two sided flexible jackets may further provide opportunities for reduction of shipping costs and/or packaging costs.

A variety of alternative embodiments of the flexible jacket having two anti-marking surfaces with projections are contemplated, several of which are described further hereinafter. In an embodiment, the flexible jacket may comprise a single sheet of material that has beads, bodies, or particles adhered and/or coupled to two planar surfaces. In an alternative embodiment, the flexible jacket may comprise two sheets of material; beads, bodies, or particles may be adhered to a first planar surface of a first sheet while a second planar surface of the first sheet has no beads, bodies, or particles; beads, bodies, or particles may be adhered and/or coupled to a third planar surface of a second sheet while a fourth planar sheet of the second sheet has no beads, bodies, or particles. The first sheet and the second sheet may be coupled to each other at a tail end and a gripper end of each sheet, with the second planar surface of the first sheet facing the fourth planar surface of the second sheet and with the first planar surface of the first sheet and the third planar surface of the second sheet facing away from each other. In an embodiment, a third sheet of material may be placed between the first and second sheet, for example to serve as packing material to adjust clearance between the transfer cylinder with the flexible jacket installed and the impression cylinder of the printing press or to provide a cushioning effect to the printed substrates as they pass over the flexible jacket. The third sheet may be installed at the time of manufacturing and may be coupled to the flexible jacket or left unattached. Alternatively, the third sheet may be inserted as an option when installing the flexible jacket for the first time over the transfer cylinder. In an embodiment, a plurality of sheets may be installed between the first and second sheet.

In an embodiment, the two anti-marking surfaces of the flexible jacket may be different from each other. For example, the first anti-marking surface may have projections of a first average size while the second anti-marking surface may have projections of a second average size. For example, the beads on the first anti-marking surface may have a first average size that is different from the second average size of the beads on the second anti-marking surface. The first anti-marking surface may have projections distributed in a first average density per unit area while the second anti-marking surface may have projections distributed in a second average density per unit area. For example, the beads coupled to the first anti-marking surface may be distributed in a first average density per unit area while the beads coupled to the second anti-marking surface may be distributed in a different second average density per unit area. The first anti-marking surface may have projections, while the second anti-marking surface may comprise one of a fabric woven of cotton threads or other natural fiber threads, a woven fabric coated with fluoropolymer, a fabric woven of fluoropolymer threads, a foil, a film, a chromium coated fabric or film, or other fabric. The use of different anti-marking surfaces promote using the same flexible jacket to perform different printing jobs by reversing the installation of the flexible jacket over the transfer cylinder, for example to accommodate and/or adapt to different substrates.

Figure 1B:
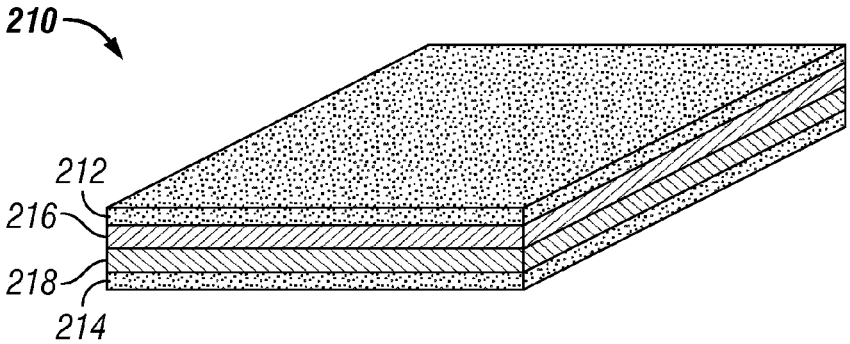
FIG. 1B is a view of a flexible jacket according to an embodiment of the disclosure.
Figure 1C:
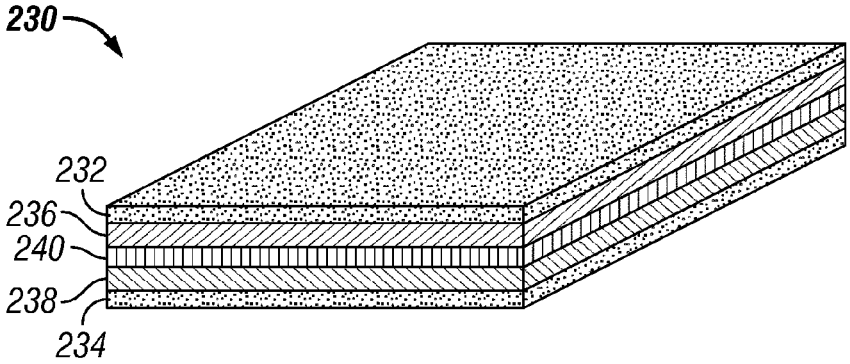
FIG. 1C is a view of a flexible jacket according to an embodiment of the disclosure.

Turning now to FIG. 1A, FIG. 1B, and FIG. 1C, several embodiments of a flexible jacket having two sides comprised of projections are described. In FIG. 1A a first flexible jacket 200 is comprised of a first surface 202, a second surface 204, and a sheet 206 disposed between the surfaces 202, 204. In some contexts, the surfaces 202, 204 may be referred to as anti-marking surfaces. Each surface 202, 204 comprises a plurality of projections that project or protrude, at least partially, from the subject surface 202, 204. In an embodiment, the projections on the first surface 202 may differ from the projections on the second surface 204 by being of different sizes and/or by being joined to the surface 202, 204 in a different density of projections per unit surface area. The different projection size and/or projection density on the different surfaces 202, 204 may permit the first flexible jacket 200 to be used effectively with different printed substrates, for example by reinstalling the first flexible jacket 200 over the transfer cylinder. In an embodiment, a water resistant and/or solvent resistant coating may be sprayed over one or more of the surfaces 202, 204, for example SCOTCHGUARD spray to reduce build up of ink or solvents and/or to promote cleaning of the surfaces 202, 204.

In some contexts the projections may be said to face outwards from the flexible jacket 200 or outwards from the surface 202, 204. It is understood that the projections associated with the first surface 202 may be said to face in a direction opposite from the projections associated with the second surface 204. As shown oriented in FIG. 1A, the projections associated with the first surface 202 may be said to face upwards while the projections associated with the second surface 204 may be said to face downwards.

The sheet 206 may comprise a variety of materials. In an embodiment, the sheet 206 may comprise a mylar sheet. In an embodiment, the sheet 206 may comprise a woven fabric sheet, such as a woven cotton sheet and/or a woven cotton canvas sheet. The projections may comprise glass material, ceramic material, silicon material, or other material. In an embodiment, the projections may be less than about 0.025 inches in diameter or that may project less than 0.025 inches above the surface. In an embodiment, the size of the projections on the first surface 202 may be different from the size of the projections on the second surface 204, for example the projections on one surface may be bigger on average than the projections on the other surface. Alternatively, the average density of projections on the first surface 202 may be different than the average density of projections on the second surface 204, for example the number of projections per unit surface area may vary between the surfaces 202 and 204. It is understood that projection manufacturing processes may result in some variation in size among the projections on the first surface 202. Likewise, the manufacturing process may result in some variation in projection density across the first surface 202.

In an embodiment, a protective sheet (not shown) may be detachably adhered to one or both of the surfaces 202, 204. The protective sheet may be adhered by static electricity, by surface attraction, or by another physical mechanism. The protective sheet is water repellant, ink repellant, and/or solvent repellant. In an embodiment, the protective sheet comprises a plastic material such as a plastic sheet or plastic film. When the first flexible jacket 200 is initially attached to the transfer cylinder, the planar side of the first flexible jacket 200 having the protective sheet detachably adhered to it is placed next to or against the transfer cylinder. The protective sheet may protect the surface 202, 204 to which it is attached from solvent and/or ink contamination.

When the surface 202, 204 facing outwards is worn beyond serviceability and/or when the surface 202, 204 suffers from excessive build up of ink and/or solvent, the first flexible jacket 200 is removed from the transfer cylinder, the protective sheet is removed, and the first flexible jacket 200 is reinstalled with the unworn surface 202, 204 facing outwards. The first flexible jacket 200 may be tumbled and then reinstalled. Alternatively the first flexible jacket 200 may be worked and turned and then reinstalled. As is known to those skilled in the art, tumbling means reversing the tail edge with the gripper edge of the first flexible jacket 200 while concurrently making the formerly inwards facing surface become the outwards facing surface. Likewise, as is known to those skilled in the art, worked and turned means keeping the tail edge of the flexible jacket proximate to the tail edge of the transfer cylinder, keeping the gripper edge of the first flexible jacket 200 proximate to the gripper edge of the transfer cylinder, and turning the first flexible jacket 200 to make the formerly inwards facing surface become the outwards facing surface and to make the formerly outwards facing surface become the inwards facing surface.

In an embodiment, for example when the projections on the first surface 202 are different in size and/or density of projections per unit surface area from the projections on the second surface 204, when a different substrate is desired to be printed, the first flexible jacket 200 may be removed from the transfer cylinder, the protective sheet adhered to the second surface 204, for example, facing the transfer cylinder may be removed, the protective sheet may be adhered to the other surface, for example the first surface 202, and the first flexible jacket 200 may be reinstalled over the transfer cylinder with the protective sheet and the first surface 202 facing the transfer cylinder. As different substrates are printed, the first flexible jacket 200 may be flipped back and forth and the protective sheet may be migrated back and forth between the surfaces 202, 204 accordingly.

In an embodiment, a protective sheet may be detachably adhered to both surface 202, 204, which may protect both surfaces 202, 204 of the first flexible jacket 200 during shipping or at other times, for example while the flexible jacket 200 is stored in inventory. A protective sheet adhered to the first surface 202 may be removed, the first flexible jacket 200 may be attached with the protective sheet adhered to the second surface 204 facing inwards towards the transfer cylinder to protect the second surface against wear and/or build up of ink and/or solvent. In an embodiment, a packing sheet may be installed between the transfer cylinder and the first flexible jacket 200. In an embodiment, the optional packing may be about as large as the width and length of the surfaces 202, 204. Alternatively, in another embodiment, the optional packing may be smaller than the size of the surfaces 202, 204 but at least as large as the width and length of the largest substrate to be printed by the printing press. In an embodiment, a plurality of packing sheets may be installed between the transfer cylinder and the first flexible jacket 200.

In FIG. 1B, a second flexible jacket 210 is comprised of a third surface 212, a fourth surface 214, a second sheet 216, and a third sheet 218. In some contexts, the surfaces 212, 214 may be referred to as anti-marking surfaces. In an embodiment, each surface 212, 214 comprises a plurality of projections that project or protrude, at least partially, from the subject surface 212, 214. In an embodiment, the projections on the third surface 212 and the projections on the fourth surface 214 may have about the same average size and may be distributed with about the same density per unit area.

In an embodiment, the second flexible jacket 210 may have different anti-marking surfaces. In an embodiment, the projections on the third surface 212 may differ from the projections on the fourth surface 214 by being of different average sizes and/or by being joined to the surface 212, 214 in a different density of projections per unit surface area. In another embodiment, the third surface 212 may comprise a plurality of projections that project or protrude, at least partially, from the third surface 212 while the fourth surface 214 and the third sheet 218 may comprise one of a fabric woven of cotton threads or other natural fiber threads, a fabric coated with fluoropolymer, a fabric woven of fluoropolymer threads, a foil, a mylar film, a chromium coated fabric or film, or other sheet of material. The different anti-marking surfaces 212, 214 of these embodiments may permit the second flexible jacket 210 to be used effectively with different printed substrates, for example by reinstalling the second flexible jacket 210 over the transfer cylinder.

In an embodiment, the projections may comprise beads, bodies, or particles that may be coupled to the surfaces 212, 214 as described above with reference to beads, bodies, or particles coupled to the surfaces 202, 204. In an embodiment, the second sheet 216 and the third sheet 218 may be substantially similar to the first sheet 206 described above with reference to FIG. 1A. The second sheet 216 and the third sheet 218 may be coupled to each other along a first edge and along an opposite edge, for example along a gripper edge and a tail edge, in a variety of manners. The sheets 216, 218 may be sown together, held together by rivets, glued together, adhered together, partially fused together, or clamped together. In an embodiment, a protective sheet may be detachably adhered to one of the surfaces 212, 214 as described above with reference to FIG. 1A. In an embodiment, a packing sheet may be installed between the transfer cylinder and the second flexible jacket 210. In an embodiment, the optional packing may be about as large as the width and length of the surfaces 212, 214. Alternatively, in another embodiment, the optional packing may be smaller than the size of the surfaces 212, 214 but at least as large as the width and length of the largest substrate to be printed by the printing press. In an embodiment, a plurality of packing sheets may be installed between the transfer cylinder and the second flexible jacket 210.

In an embodiment, the third sheet 218 may be different from the first sheet 206 and may not have projections on the fourth surface 214. In an embodiment, the second sheet 216 having projections on the third surface 212 is coupled to a net structure, such that the net structure has slack and is loose when the flexible jacket 210 is attached to the transfer cylinder with the third surface facing the transfer cylinder. The net structure may comprise a woven cotton fabric, such as the Super Blue® system. The net structure may be a fabric woven of cotton threads or other natural fiber threads. The net structure may comprise a woven cotton fabric that is coated with anti-friction material and/or coated with fluoropolymer, for example coated with polytetrafluoroethylene (PTFE) (sold under the trademark TEFLON available from DuPont Corporation and under the trademark XYLAN available from Whitford). The net structure may comprise a woven fabric comprising threads formed of fluoropolymer material. In an embodiment, the net structure is relatively thin and is about as long and wide as the second sheet 216, though the net structure may be somewhat shorter or longer than the second sheet 216. For further details on net structures comprising a woven fabric comprising threads formed of fluoropolymer material, see U.S. patent application Ser. No. 12/03422,481, filed Dec. 24, 2008, entitled "Anti-marking Jackets Comprised of Fluoropolymer and Methods of Using in Offset Printing," by Howard W. DeMoore, et al., which is hereby incorporated by reference in its entirety.

In FIG. 1C, a third flexible jacket 230 is comprised of a fifth surface 232, a sixth surface 234, a fourth sheet 236, a fifth sheet 238, and an intermediate sheet 240. The surfaces 232, 234, and sheets 236, 238 may be substantially similar to the surfaces 212, 214 and sheets 216, 218 described above with reference to FIG. 1B. The sheets 236, 238 may be coupled to each other in one of the coupling manners described above with reference to FIG. 1B. The intermediate sheet 240 may be coupled to one or both of the sheets 236, 238. Alternatively, the intermediate sheet 240 may be positioned between the sheets 236, 238 and not coupled to either sheet.

The intermediate sheet may be used as packing material, to increase the thickness of the third flexible jacket 230 when attached to a transfer cylinder or to another cylinder of a printing press. Alternatively or in addition, the intermediate sheet may provide some cushioning to the printed substrates as they contact the third flexible jacket 230. In an embodiment, a protective sheet may be detachably adhered to one of the surfaces 232, 234 as described above with reference to FIG. 1A. The intermediate sheet 240 may comprise neoprene rubber, open celled polyurethane foam, reticulated foam, or another material suitable for providing one of a thickness and/or a cushioning effect. In an embodiment, the intermediate sheet 240 may be approximately the same size as the sheets 236, 238. Alternatively, in another embodiment, the intermediate sheet 240 may be smaller than the sheets 236, 238 but at least as large as the size of the largest substrate that would be printed in the subject printing press. In an embodiment, a plurality of sheets may be positioned between the sheets 236, 238, for example for use as packing material.

Figure 1D:
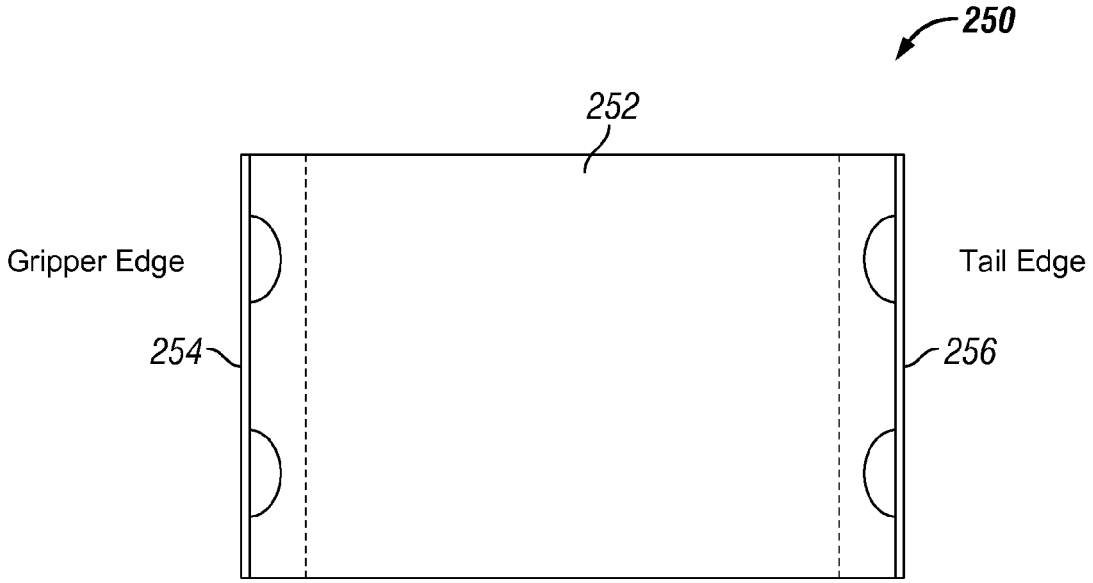
FIG. 1D is a top view of a flexible jacket according to an embodiment of the disclosure.
Figure 1E:
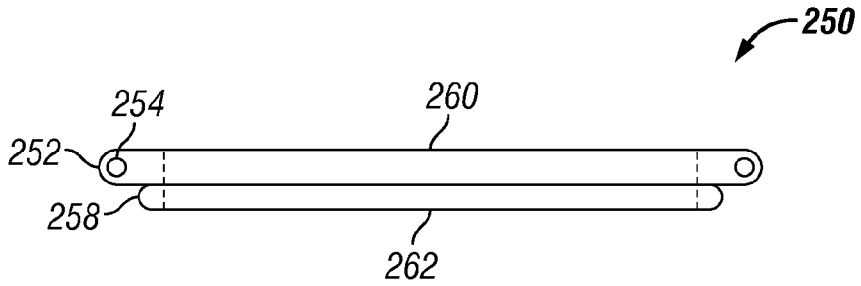
FIG. 1E is a side view of the flexible jacket of FIG. 1D according to an embodiment of the disclosure.

Turning now to FIG. 1D and FIG. 1E, alternative views of a flexible jacket 250 are provided. In FIG. 1D and FIG. 1E, the flexible jacket 250 is intended to be representative of any of the flexible jackets 200, 210, 230. The left edge of the flexible jacket 250 may be referred to as a gripper edge and the right edge of the flexible jacket 250 may be referred to as a tail edge. It is understood that associating the terms tail edge and gripper edge to the ends of the flexible jacket 250 could be reversed. Additionally, in some embodiments the flexible jacket 250 may be reversible such that the left edge of the flexible jacket 250 may be installed at a gripper edge of a transfer cylinder in a first case and then reinstalled at a tail edge of the same transfer cylinder. In an embodiment, a first rod 254 extends through a loop formed in the gripper edge and a second rod 256 extends through a loop formed in the tail edge of the flexible jacket 250. The rods 254, 256 may be employed to couple the flexible jacket 250 to a transfer cylinder or other cylinder of the printing press. In an embodiment, the rods 254, 256 may be removable and reused when replacing a worn flexible jacket 250. Alternatively, in another embodiment, the rods 245, 256 are considered to be part of the assembly of the flexible jacket 250 and are discarded along with a worn flexible jacket 250. In yet another embodiment, a different attachment mechanism may be employed to attach the flexible jacket 250 to the transfer cylinder or other cylinder of the printing press.

The flexible jacket 250 may have a seventh surface 260 and an eighth surface 262. Initially, the flexible jacket 250 may be installed over a transfer cylinder with the eighth surface 262 facing and/or touching the transfer cylinder and with the seventh surface 260 facing away from the transfer cylinder and/or outwards. The associated printing press may be operated to print a plurality of substrates, the substrates passing over, contacting, and gradually wearing the seventh surface 260 and/or the projections projecting from the surface of the seventh surface 260. In some cases the flexible jacket 250 may have a service life of more than a million substrates. When the seventh surface 260 and/or the projections projecting from the surface of the seventh surface 260 have worn to or beyond the limits of serviceability, the flexible jacket 250 may be removed from the transfer cylinder, flipped over, and reinstalled to the transfer cylinder with the seventh surface 260 (worn surface) now facing and/or touching the transfer cylinder and with the eighth surface 262 facing away from the transfer cylinder and/or outwards. Alternatively or in addition, the flexible jacket may accumulate an undesirable build-up of ink, solvent, or other material such that the subject flexible jacket is no longer function suitably, and the flexible jacket 250 may be removed, flipped, and reinstalled accordingly. If an optional protective sheet is adhered to the eighth surface 262, the protective sheet is removed before operating the printing press with the eighth surface 262 facing outwards. Because the eighth surface 262 has not been contacting substrates and thereby not experiencing wear, the eighth surface 262 is substantially new and may be expected to provide a full service life, for example a million or more printing cycles.

As already discussed above, the flexible jackets may comprise different anti-marking sheets. In an embodiment, at least one of the size of the projections or the density of projections per unit surface area may be different on the two outwards facing surfaces of the flexible jackets 200, 210, 230. The size of projections and/or the density of projections per unit surface area of the surface of the flexible jacket 200, 210, 230 engaging the printed substrate as it passes through a printing press may be selected to be suitable to the characteristics and/or qualities of the subject substrate or of the print image itself. When a first print order is completed and the printing press is being set-up to begin a second print order, the flexible jacket 200, 210, 230 may be removed and reinstalled to present the formerly inwards facing surface to now face outwards and engage the substrates of the second print order.

The size of projections and/or the density of projections per unit surface area of each of the two outwards facing surfaces of the flexible jackets 200, 210, 230 may be selected to provide a compromise solution for a range of different contemplated printing parameters or characteristics. The combination of outwards facing surfaces with different sized projections and/or different densities of projections per unit surface area may reduce set-up time between different print jobs, as the pressman may not need to leave the press to fetch a flexible jacket 200, 210, 230 with suitable projection design. Notwithstanding this contemplated embodiment, other embodiments of the flexible jacket 200, 210, 230 may feature substantially similar projection sizes and/or projection density per unit area on both outwards facing surfaces. Likewise, the flexible jackets 210, 230 may comprise a first anti-marking surface having projections and a second anti-marking surface without projections, for example an anti-marking surface comprising a fabric woven of natural fiber threads, a fabric coated with fluoropolymer, a fabric woven of fluoropolymer threads, a mylar film, a chromium coated fabric or film, or other anti-marking sheet.

The various embodiments of the flexible jacket 250—jacket 200, 210, 230—provide convenience and ease of operation for press operators. When replacing worn flexible jackets 250, the press operator can save time of retrieving a new flexible jacket 250 from storage and disposing a worn flexible jacket 250. Effectively, the press operator will retrieve and dispose the flexible jacket 250 half as often as would be the case with a single sided flexible jacket as known in the prior art. Additionally, it is contemplated that manufacturing processes may realize efficiencies that can support delivering the two sided flexible jacket 250 at a discounted price relative to the price of two separate flexible jackets as known in the prior art.

In different circumstances different flexible jackets 200, 210, 230 may be preferred. For example, in some circumstances the first flexible jacket 200 may be less expensive to manufacture per unit than the second and third flexible jackets 210, 230 but may entail higher initial manufacturing tooling expense. If the production run is expected to be large, it may be expected that the initial manufacturing tooling expense will be overcome by the lower per unit manufacturing cost. On the other hand, if the production run is expected to be low or of uncertain quantity, either the second or third flexible jacket 210, 230 may be preferred. Further, it may be that either the first flexible jacket 200 has longer service life or the second flexible jacket 210 has longer service life, which may further help select which embodiment to manufacture.

In an embodiment, the third sheet 218 and the fourth surface 214 may be shorter than the second sheet 216 and the second surface 212. The attachment mechanism, for example the rod 254, may be coupled to the second sheet 216, but the third sheet 218 may not need to extend completely to the end of the second sheet 216 and is coupled to the second sheet 216. Thus, in some embodiments, the manufacturing of the flexible jackets 210, 230 may consume somewhat less material to manufacture than two separate single sided flexible jackets of the prior art. Likewise, the first flexible jacket 200 may consume half as much sheet material as two separate single sided flexible jackets of the prior art. The manufacture of the flexible jackets 200, 210, 230 may also exhibit labor savings when compared with manufacturing two single sided flexible jackets of the prior art.

Figure 2:
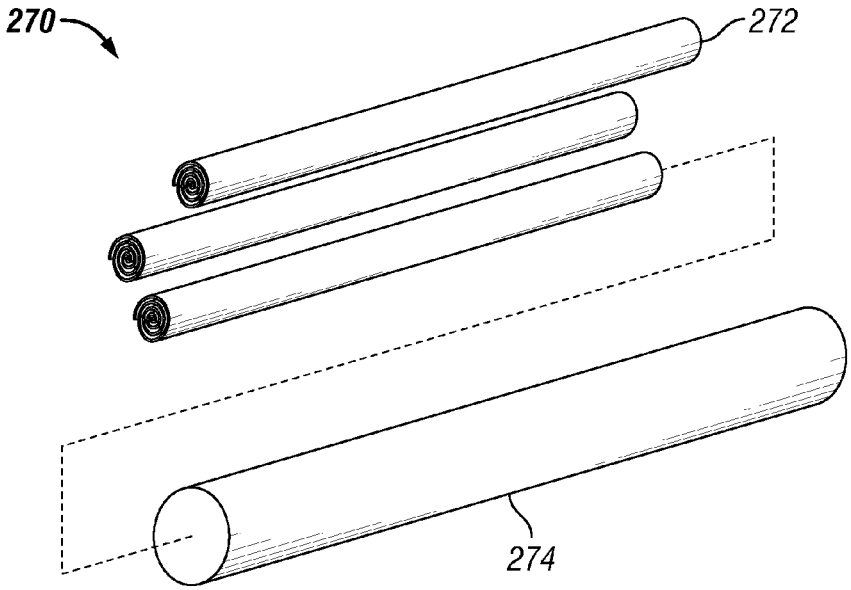
FIG. 2 is an illustration of a kit according to an embodiment of the disclosure.

Turning now to FIG. 2, a kit 270 is described. The kit may comprise a plurality of flexible jackets 272 and a shipping carton 274. The flexible jackets 272 may be substantially similar to one or more of the flexible jackets 200, 210, 230 described above with reference to FIG. 1A, FIG. 1B, and FIG. 1C. In preparation for shipping and/or storing, the flexible jackets 272 may be rolled up and inserted into the shipping carton 274. The shipping carton 274 may be comprised of any of a variety of materials not limited to cardboard, plastic, aluminum, or heavy paper. The flexible jackets 272 may be manufactured, rolled, inserted into the shipping carton 274 in quantities of two, three, four, or more. In an embodiment, the ends of the shipping carton 274 may be closed with tape, with a cap, or by stapling and/or crimping the ends together. In an embodiment, the anti-marking surfaces of the flexibly jackets 272 may be different from each other, as described further above.

Figure 3:
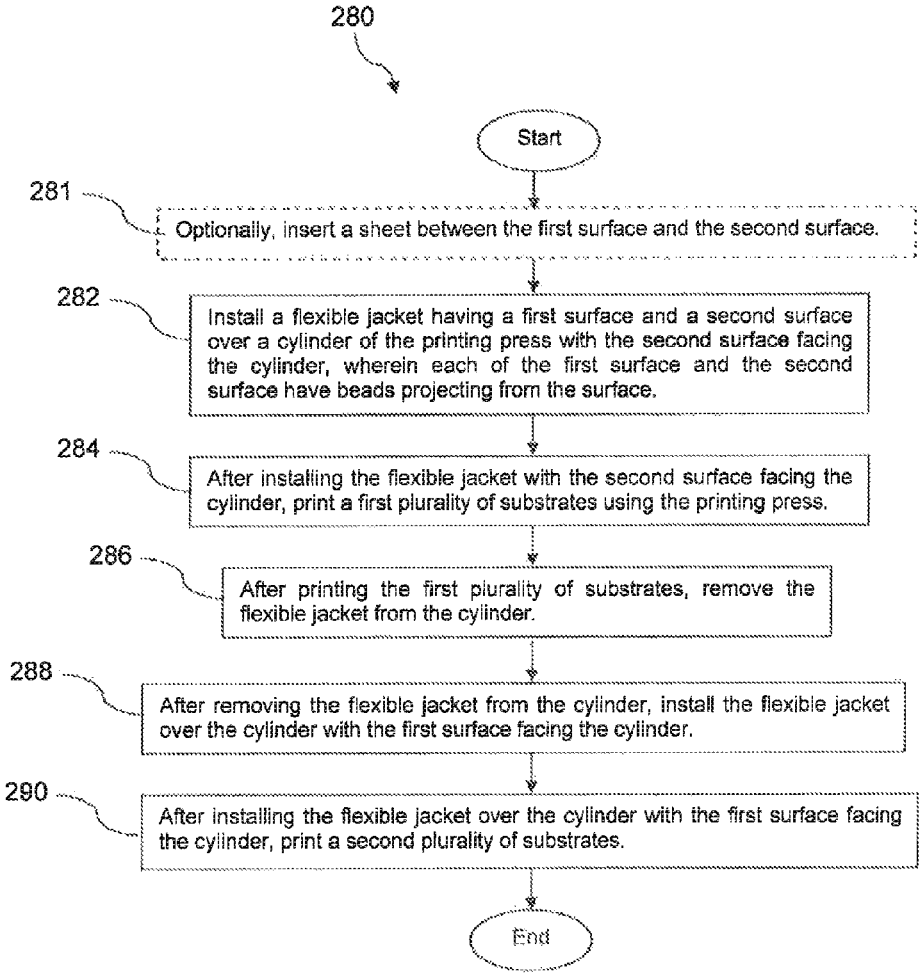
FIG. 3 is a flow chart of a method according to an embodiment of the disclosure.

Turning now to FIG. 3, a method 280 is described. At block 281, a sheet may optionally be inserted between a first surface and a second surface of a flexible jacket, for example the second flexible jacket 210. In an embodiment, a plurality of sheets may optionally be inserted between the first surface and the second surface of the flexible jacket. At block 282, a flexible jacket having a first surface and a second surface is installed over a cylinder of a printing press, wherein each of the first surface and the second surface have projections projecting from the surface. At block 284, after installing the flexible jacket with the second surface facing the cylinder, print a first plurality of substrates using the printing press. At block 286, after printing the first plurality of substrates, remove the flexible jacket from the cylinder. At block 288, after removing the flexible jacket from the cylinder, install the flexible jacket over the cylinder with the first surface facing the cylinder. At block 290 after installing the flexible jacket over the cylinder with the first surface facing the cylinder, print a second plurality of substrates. Any of the flexible jackets 200, 210, 230 may be employed for blocks 282, 284, 286, 288, 290.

Figure 4A:
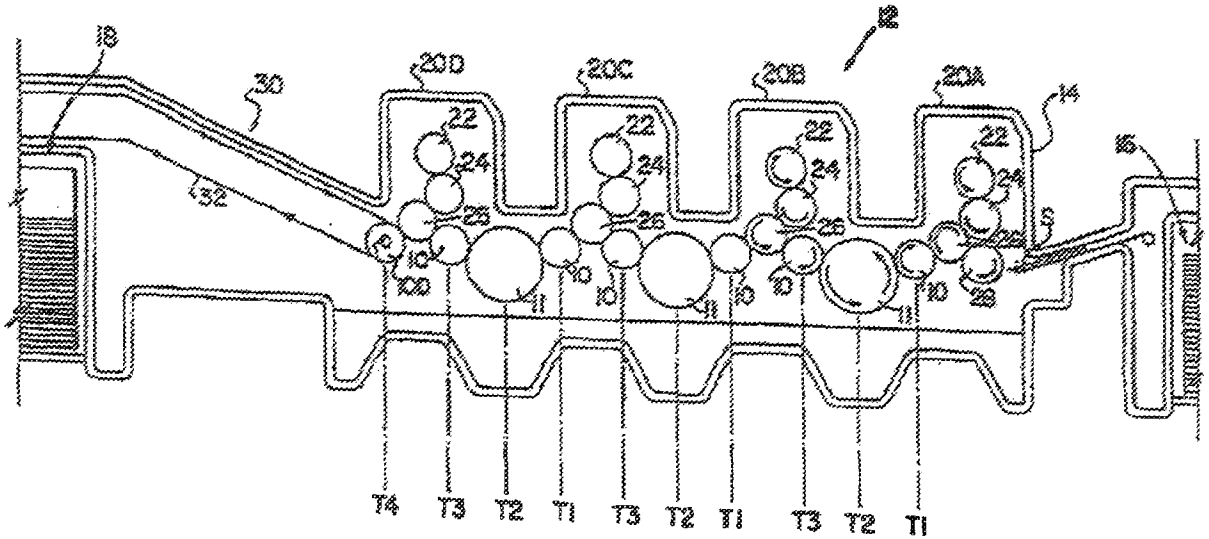
FIG. 4A is a schematic side elevational view showing multiple transfer cylinders installed at substrate transfer positions in a four color rotary offset printing press of a type made by Heidelberg Druckmaschinen Aktiengesellschaft.
Figure 4B:
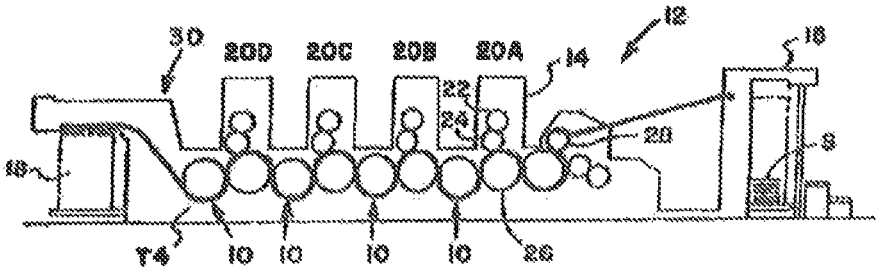
FIG. 4B is a schematic side elevational view showing multiple transfer cylinders installed at substrate transfer positions in a four color rotary offset printing press of the Lithrone Series made by Komori Corp.

For exemplary purposes, a flexible jacket 100 and the optional base cover will be described with reference to the processing of sheet substrates. However, it will be understood that the principles of the disclosure are equally applicable to web substrates. The flexible jacket 100 may be implemented as any one of the flexible jackets 200, 210, 230, 250 described above. The flexible jacket 100 of the present disclosure and the optional base cover may be used in combination with high-speed printing press equipment of the type used, for example, in offset printing. FIG. 4A shows a typical, four color offset printing press of the type made by Heidelberg Druckmaschinen Aktiengesellschaft, and FIG. 4B shows a four color offset printing press of the Lithrone Series available from Komori Corp. Referring to FIGS. 3A and 3B, such equipment includes one or more transfer cylinders 10 for handling a processed substrate, such as a freshly printed sheet between printing units and upon delivery of the printed sheet to a delivery stacker. The flexible jacket 100 of the present disclosure and the optional base cover are installed on transfer cylinders 10. As used herein, the term "processed" refers to various printing methods, which may be applied to either side or both sides of a substrate, including the application of aqueous inks, protective coatings and decorative coatings. The term "substrate" refers to sheet material or web material.

Use of the present disclosure, in combination with the transfer cylinder 10 at an interstation transfer position (T1, T3) or at a delivery position (T4) in a typical rotary offset printing press 12, is believed to be readily understandable to those skilled in the art. In any case, reference may be made to U.S. Pat. Nos. 3,791,644 and 4,402,267, which disclose details regarding the location and function of a sheet support cylinder in a typical multistation printing press. The present disclosure may, of course, be utilized with conventional printing presses having any number of printing units or stations.

Referring to FIGS. 4A and 4B, the press 12 includes a press frame 14 coupled on its input end to a sheet feeder 16 from which sheets, herein designated S, are individually and sequentially fed into the press. At its delivery end, the press 12 is coupled to a sheet stacker 18 in which the printed sheets are collected and stacked. Interposed between the sheet feeder 16 and the sheet stacker 18 are four substantially identical sheet printing units 20A, 20B, 20C, and 20D which are capable of printing different color inks onto the sheets as they are transferred through the press.

As illustrated in FIGS. 4A & 4B, each printing press is of conventional design, and includes a plate cylinder 22, a blanket cylinder 24, and an impression cylinder 26. Freshly printed sheets S from the impression cylinder 26 are transferred to the next printing press by a transfer cylinder 10. The initial printing unit 20A is equipped with a sheet in-feed roller 28 which feeds individual sheets one at a time from the sheet feeder 16 to the initial impression cylinder 26. In an embodiment, the transfer cylinder 10 may be painted a color that promotes discernment of negatively defined visual stripes in the optional base cover by a print operator.

The freshly printed sheets S are transferred to the sheet stacker 18 by a delivery conveyor system, generally designated 30. The delivery conveyor system 30 is of conventional design and includes a pair of endless delivery gripper chains 32 carrying transversely disposed gripper bars, each having gripper elements for gripping the leading edge of a freshly printed sheet S as it leaves the impression cylinder 26 at the delivery position T4. As the leading edge of the printed sheet S is gripped by the grippers, the delivery gripper chains 32 pull the gripper bars and sheet S away from the impression cylinder 26 and transport the freshly printed sheet S to the sheet delivery stacker 18.

Referring to FIG. 4A, an intermediate transfer cylinder 11 receives sheets printed on one side from the transfer cylinder 10 of the preceding printing unit 20. Each intermediate transfer cylinder 11, which is of conventional design, typically has a diameter twice that of the transfer cylinder 10, and is located between two transfer cylinders 10, at interstation transfer positions T1, T2 and T3, respectively. The impression cylinders 26, the intermediate transfer cylinders 11, the transfer cylinders 10, as well as the sheet in-feed roller 28, are each provided with sheet grippers which grip the leading edge of the sheet to pull the sheet around the cylinder in the direction as indicated by the associated arrows. The transfer cylinder 10 in the delivery position T4 is not equipped with grippers, and includes instead a large longitudinal opening A, which provides clearance for passage of the chain driven delivery conveyor gripper bars. In some printing press installations, an artificial radiation source, for example an ultraviolet lamp and/or an infrared lamp, may be mounted to radiate semi-directly or directly onto the interstation transfer positions T1, T2, and T3. The artificial radiation may be employed to cure and/or set the wet ink on printed substrates as they pass through the printing press.

Figure 6B:
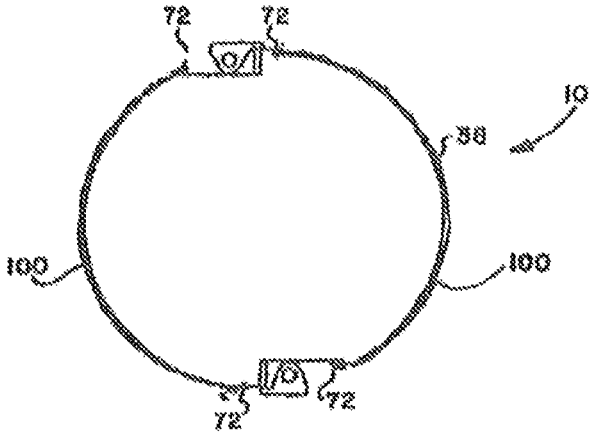
FIG. 6B is a cross-sectional view of a transfer cylinder of a type commonly used on Lithrone Series printing presses made by Komori Corp.
Figure 5:
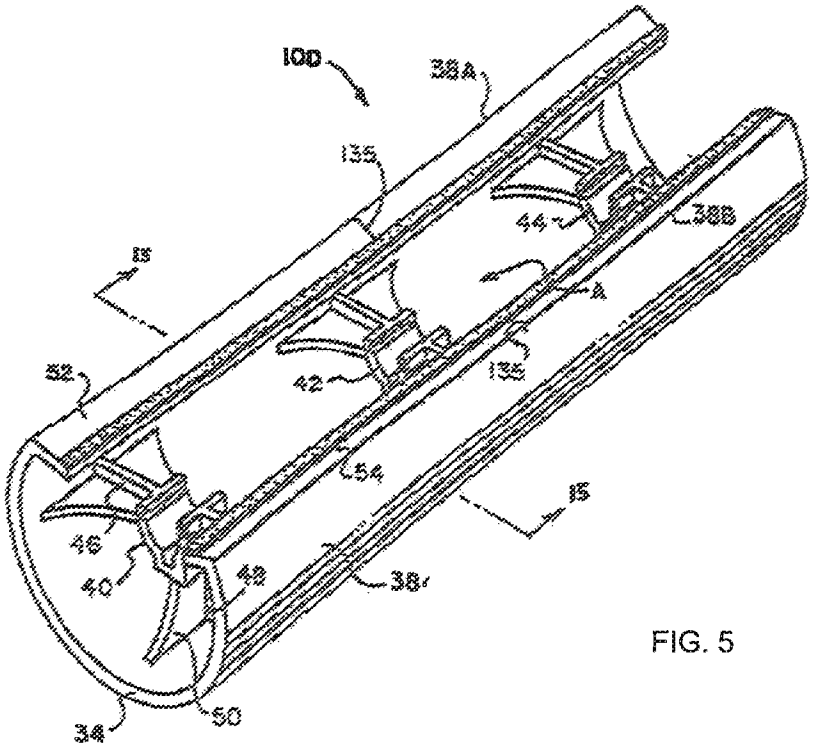
FIG. 5 is a perspective view of a transfer cylinder of a type commonly used on printing presses made by Heidelberg Druckmaschinen Aktiengesellschaft.
Figure 6A:
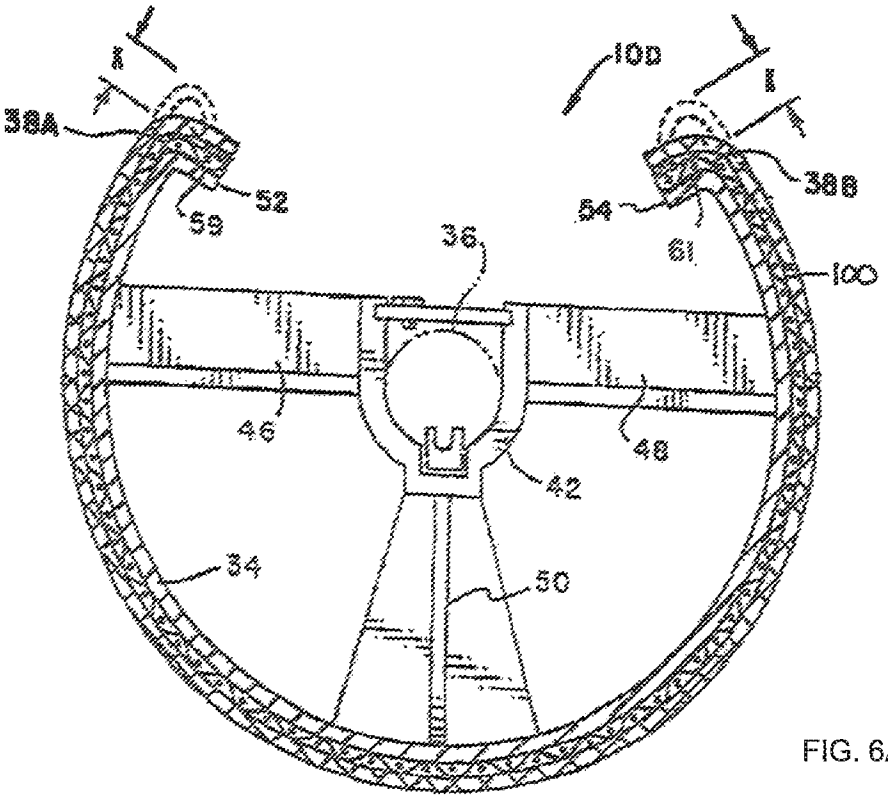
FIG. 6A is a cross-sectional view of a transfer cylinder taken along line 15-15 of FIG. 4 having an integrated, anti-marking cover installed thereon.

Referring now to FIGS. 5 and 6A, a preferred transfer cylinder 10D is shown for use with the Heidelberg printing press of FIG. 4A. The flexible jacket 100 and the optional base cover described herein above are installed on a transfer cylinder 10D on the last printing unit 20D of the press 12 in the delivery position (T4) and has a cylindrical rim 34, which is supported for rotation on the press frame 14 by a rotatable delivery shaft 36. The external cylindrical surface 38 of the cylindrical rim 34 has a gap "A" extending longitudinally along the length of the transfer cylinder 10D and circumferentially between gripper edge 38A and tail edge 38B, respectively. The transfer cylinder 10D is attached to the delivery shaft 36 by longitudinally spaced hubs 40, 42 and 44. Additionally, center alignment marks 135 are formed on the cylinder flanges portions 52, 54 and on the external cylindrical surface 38 of the cylindrical rim 34, as shown in FIG. 5. The purpose of the center alignment marks 135 is to facilitate the precise alignment and attachment of the flexible jacket 100 and/or the optional base cover to the transfer cylinder 10. In an embodiment, a center alignment mark 135 may also be provided on the flexible jacket 100 and/or the optional base cover.

The hubs 40, 42, and 44 are connected to the cylindrical rim 34 by webs 46, 48 and 50, and support the transfer cylinder 10D for rotation on the delivery shaft 36 of the printing press 12 in a manner similar to the mounting arrangement disclosed in U.S. Pat. No. 3,791,644. In the embodiment shown in FIG. 5, the delivery cylinder 10D includes opposed cylinder flanges 52, 54, which extend generally inwardly from the surface of the cylindrical rim portion 34. The flanges 52 and 54 include elongated flat surfaces for securing the flexible jacket 100 and the optional base cover as described below. As described herein, transfer cylinders 10 may have alternative configurations for accommodating the various means for releasably attaching the flexible jacket 100 and the optional base cover to the transfer cylinder 10 as described herein.

Referring to FIG. 6B, a cross-sectional view of preferred transfer cylinder 10 is shown for use with the Lithrone Series printing press of FIG. 4B. Transfer cylinder 10 is designed and configured to accept a pair of flexible jackets 100, with a first flexible jacket 100 covering about one-half of the cylindrical surface 38 of the transfer cylinder 10 and a second flexible jacket 100 covering about the remaining one-half of the cylindrical surface 38. The flexible jacket 100 is releasably attached to the transfer cylinder 10 at the jacket tail edge and the jacket gripper edge with flat clamp bar 72 held in place with a series of spring loaded screws spaced along the length of the clamp bar 72. In some cases, the flexible jacket 100 is attached by various means including, but not limited to, hook and loop fabric material such as VELCRO that mates adheringly to the flexible jacket 100, an adhesive strip or tape, and other adhering means. For example, the adhesive strip may be coupled on one side to the flexible jacket 100 through one of a heating process and a pressure process. In embodiment, a portion of the adhesive strip may be extruded through an edge of the flexible jacket 100 to couple the adhesive strip to the flexible jacket 100. For example, the extruded portion of the adhesive strip may form end caps or structures like rivets on the opposite side of the flexible jacket 100 to secure the adhesive strip to the flexible jacket 100. The extruded portion of the adhesive strip may partially form an interlocking matrix on the opposite side of the flexible jacket 100 to secure the adhesive strip to the flexible jacket 100. In an embodiment, a portion of the flexible jacket 100 along the edge may be abraded to provide a more suitable mating surface for coupling to a hook and loop fastener, for example VELCRO. In an embodiment, the flexible jacket 100 may be precision cut to promote simple installation and proper free play without adjustment. It is contemplated that the flexible jacket 100, taught by the present disclosure, may provide extended usage cycles relative to known designs for flexible jackets. The flexible jacket 100 may be removed, washed, and reinstalled multiple times before the flexible jacket 100 wears out.

The function and operation of the transfer cylinders 10 and associated grippers of the printing units 20 are believed to be well known to those familiar with multi-color sheet fed presses, and need not be described further except to note that the impression cylinder 26 functions to press the sheets against the blanket cylinders 24 which applies ink to the sheets, and the transfer cylinders 10 guide the sheets away from the impression cylinders 26 with the wet printed side of each sheet facing against the support surface of the transfer cylinder 10. Since each transfer cylinder 10 supports the printed sheet with the wet printed side facing against the transfer cylinder support surface, the transfer cylinder 10 is provided with the flexible jacket 100 and the optional base cover as described herein. The flexible jacket 100 and the optional base cover are releasably attached to the transfer cylinder 10 by means for releasably attaching the flexible jacket 100 and the optional base cover to a transfer cylinder 10. In an embodiment shown in FIG. 6A, the flexible jacket 100 is connected to the transfer cylinder flanges 52 and 54 by the hook and loop (i.e., VELCRO) fastener strips 59, 61.

Alternatively, the flexible jacket 100 may be, at least partially, connected to the transfer cylinder 10 using adhesive strip, as described above. In an embodiment shown in FIG. 4A, the flexible jacket 100 may be attached to the transfer cylinder flanges 52 and 54 by mechanical mechanisms, for example by mechanical fasteners such as screws; mechanical take up reels or any other forms of mechanical roll up bars (often referred to collectively as reel cylinders); and the like. The flexible jacket 100 may have rods extending through loops in a gripper edge and a tail edge, and the flexible jacket 100 may attach the to the transfer cylinder 10 by snapping the rods over receiving screws at the corresponding edges of the transfer cylinder 10.

While several embodiments have been provided in the present disclosure, it should be understood that the disclosed systems and methods may be embodied in many other specific forms without departing from the spirit or scope of the present disclosure. The present examples are to be considered as illustrative and not restrictive, and the intention is not to be limited to the details given herein. For example, the various elements or components may be combined or integrated in another system or certain features may be omitted or not implemented.

Also, techniques, systems, subsystems, and methods described and illustrated in the various embodiments as discrete or separate may be combined or integrated with other systems, modules, techniques, or methods without departing from the scope of the present disclosure. Other items shown or discussed as directly coupled or communicating with each other may be indirectly coupled or communicating through some interface, device, or intermediate component, whether electrically, mechanically, or otherwise. Other examples of changes, substitutions, and alterations are ascertainable by one skilled in the art and could be made without departing from the spirit and scope disclosed herein.

What we claim is:

1. A method of operating a printing press, comprising:

installing a flexible jacket having a first surface and a second surface over a cylinder of the printing press with the second surface facing the cylinder, wherein each of the first surface and the second surface have projections projecting from the surface, and wherein the cylinder is one of a transfer cylinder or a delivery cylinder;

after installing the flexible jacket with the second surface facing the cylinder, printing a first plurality of substrates using the printing press;

transferring the printed first plurality of substrates by contacting the first surface of the flexible jacket with the printed first plurality of substrates;

after printing the first plurality of substrates, removing the flexible jacket from the cylinder;

after removing the flexible jacket from the cylinder, installing the flexible jacket over the cylinder with the first surface facing the cylinder;

after installing the flexible jacket with the first surface facing the cylinder, printing a second plurality of substrates using the printing press; and transferring the printed second plurality of substrates by contacting the second surface of the flexible jacket with the printed second plurality of substrates.

2. The method of claim 1, wherein an average size of the projections on the first surface is about the same as an average size of the projections on the second surface.

3. The method of claim 1, wherein an average size of the projections on the first surface is different from an average size of the projections on the second surface.

4. The method of claim 1, further comprising:

after printing the first plurality of substrates and removing the flexible jacket from the cylinder, adhering a protective sheet over the first surface before installing the flexible jacket over the cylinder with the first surface facing the cylinder;

after printing the second plurality of substrates, removing the flexible jacket from the cylinder;

after printing the second plurality of substrates and after removing the flexible jacket from the cylinder, removing the protective sheet from the first surface and adhering the protective sheet over the second surface;

after adhering the protective sheet over the second surface, installing the flexible jacket over the cylinder with the second surface facing the cylinder; and after adhering the protective sheet over the second surface and installing the flexible jacket over the cylinder with the second surface facing the cylinder, printing a third plurality of substrates using the printing press.

5. The method of claim 1, further comprising before printing the second plurality of substrates, removing a protective sheet from the second surface.

6. The method of claim 1, wherein an average density per unit area of projections on the first surface is about the same as an average density per unit area of projections on the second surface.

7. The method of claim 1, wherein the flexible jacket comprises a sheet of material having beads adhered to a first side of the sheet of material and beads adhered to a second surface of the sheet of the material.

8. The method of claim 7, wherein the beads are one of glass beads, silicon beads, or ceramic beads.

9. The method of claim 7, wherein the beads are less than 0.025 inches in diameter.

10. The method of claim 1, wherein an average density per unit area of projections on the first surface is different from an average density per unit area of projections on the second surface.

* * * * *